US005996566A

United States Patent [19]

Malan

[11] Patent Number: 5,996,566

[45] Date of Patent: Dec. 7, 1999

[54] ARCHERY BOW

[76] Inventor: Lee Malan, 5662 Lincoln Cir. East, Lake Worth, Fla. 33463-6755

[21] Appl. No.: 09/176,977

[22] Filed: Oct. 22, 1998

[51] Int. Cl.[6] ..... F41B 5/00

[52] U.S. Cl. ..... 124/23.1; 124/25.6

[58] Field of Search ..... 124/23.1, 25.6, 124/86, 88

[56] References Cited

U.S. PATENT DOCUMENTS

| | | | |
|---|---|---|---|
| 3,674,001 | 7/1972 | Hitt . | |
| 3,744,473 | 7/1973 | Nishioka . | |
| 3,812,835 | 5/1974 | Smith | 124/25.6 |
| 3,989,026 | 11/1976 | Nishioka . | |
| 4,646,708 | 3/1987 | Imes | 124/25.6 X |
| 4,903,677 | 2/1990 | Colley et al. . | |
| 5,408,982 | 4/1995 | Doornenbal | 124/23.1 |
| 5,651,354 | 7/1997 | LaHaise | 124/23.1 |
| 5,706,794 | 1/1998 | Neal | 124/25.6 |

*Primary Examiner*—John A. Ricci
*Attorney, Agent, or Firm*—McHale & Slavin

[57] ABSTRACT

An archery bow having a pair of lever arms pivotally attached to opposite ends of an elongated handle structure. The handle structure is contoured to fit an individual's hand, and the lever arms may be selectively removed for convenient storage and travel. Free ends of each lever arm include a bow string guide that accommodates an included bow string. The bow string is placed around the string guides, and the bow string ends are secured to anchoring posts located on the handle structure. At least one biasing member is attached to the handle structure. Biasing bar free ends engage a corresponding lever arm. Drawing the bow string away from the handle structure to force the biasing bar free ends against the lever arms raises the potential energy within the bow.

21 Claims, 5 Drawing Sheets

ARCHERY BOW

FIELD OF THE INVENTION

This invention relates generally to archery bows and more specifically to an adjustable pivot arm bow that may be dismantled for storage or configured for various performance aspects.

BACKGROUND OF THE INVENTION

Archery bows have long been used by hunters and sportsmen. A conventional archery bow is formed from a single piece or pair of elongated arms that extend from a central handle. A bow string extends between the ends of the elongated arms and placed in a highly-tensioned position. Opposite ends of a loaded arrow are supported by the handle and bow string. Drawing the bow string increases the potential energy within the bow, placing an arrow in a launch-ready state.

In some archery bow designs, the arms are fixed and bend when the bow string is pulled. In this type of bow, often called a recurve bow, pulling the bow string to bend the arms raises the potential energy within the bow. The increased potential energy is stored primarily in the flexed arms until the bow string is released. Accordingly, the force required to draw the bow string and the resulting arrow-launch force are products of the arm materials and geometry. Unfortunately, many archers are not able to use high-powered versions of this type of bow. For example, versions that gain power from long, relatively-pliant arms may be too cumbersome for use by many individuals. Alternately, high-powered versions that use compact, relatively-stiff arms may require more pull force than many archers can provide. Recurve bow have the additional drawback of limited adjustability. Once the bow is made, it is often difficult, if not impossible, to vary the bow's operating characteristics.

One example of a recurve bow is disclosed in U.S. Pat. No. 3,674,001. This archery bow has both primary arms and auxiliary arms. The arms are flexible, and the auxiliary arms are positioned to resist motion of the primary arms. This cooperative arrangement produces a relatively higher-powered bow, when compared with bows including the primary arms only.

In other bow designs, such as U.S. Pat. No. 3,989,026, the arms are rigid and the bow string is connected to a system of cables, springs, and pulleys. In this type of bow, pulling the bow string increases the potential energy within the bow by loading the springs. The increased energy is stored primarily within the springs until the bow string is released to launch an arrow. This type of bow, often called a compound bow, is usually adjustable. Altering the springs, for example, will change the required bow string pull weight and resultant arrow-launching forces. Additionally, the pulleys may have non-circular perimeters that provide a mechanical advantage that lowers the force required to keep the bow string pulled back in a ready-to-launch position. A compound bow that relies on a network of cables and pulleys, many compound bows can not be readily dismantled. Although some compound bows have detachable arms, the included cables can make removing and reattaching the arms difficult or maintenance-intensive. Additionally, although compound bow characteristics are more a function of spring forces than arm length, there is a minimum bow length which be maintained to create a useful device. As bow length decreases, so to does the angle between the arrow and bow string. If this angle is too small, the bow string will pinch the archer's fingers when the bow string is pulled back during use.

As mentioned above, U.S. Pat. No. 3,989,026 is an example of a compound archery bow. In the '026 device, a bow string is directed around the bow frame by a series of guides; the bow string is attached to a single tension-producing member. The single tension producing member ensures uniform tension throughout the bow. By including only one such member, this bow eliminates tension variances that are common in bows with two or more tension-producing members. The bow arm angles may be adjusted with respect to a central beam, and the arms may also be removed.

U.S. Pat. No. 4,903,677 discloses yet another compound bow. The bow has a rigid frame and energy is stored within flat, coiled springs mounted on the frame. Applying a tensile force to the bow string increases energy within the flat coiled springs. The energy is, in turn, transferred to a bow string to launch an arrow.

Another type of bow, such as that depicted in U.S. Pat. No. 3,744,473, includes design elements borrowed from both recurve and compound bows. This type of hybrid bow typically has rigid, pivoting portions attached to a fixed handle. These hybrid bow designs employ the cable systems found on compound bows and incorporate a modified version of the moving limb motion common to recurve bows. As a result, hybrid bows are adjustable to a degree, and do not rely solely on limb flexibility for power generation. However, such hybrid bows are difficult to store and dismantle.

The '473 patent discloses a hybrid archery bow having rotatable, spring-loaded arms. The arms are connected to a central beam by rotating wheels. Cables extend between the wheels to ensure that the arms rotate in uniform, yet opposite, directions when the bow string is pulled.

What is needed in this art is an archery bow that encompasses the features of the known bow designs, while overcoming the difficulties faced so far. The bow should be simple in construction, so that it may dismantled for easy storage and travel. Additionally, the bow should be lightweight and adjustable so that it may be used in a variety of situations by archers of varying strength and skill. Finally the bow should be capable of high-powered configurations without producing cumbersome dimensions or necessitating unreasonable pull weights.

SUMMARY OF THE INVENTION

The present invention is an archery bow that has an adjustable pull weight and may be selectively dismantled. The bow employs a first lever arm and a second lever arm pivotally connected to opposite ends of an elongated handle structure. The free end of each lever arm includes a string guide that accommodates a removable bow string.

A bow string is strung around these string guides, and the string ends are secured to anchor posts located on the handle structure. So positioned, the bow string forms a generally-contiguous loop whose contours change as the lever arms move with respect to the handle structure.

At least one resiliently-deflectable biasing member is attached to the handle structure. A fixed portion of each biasing member is removably secured to the handle structure, and biasing member free ends each include a roller. Each biasing member roller engages a rearward surface of a corresponding lever arm.

When the bow string is drawn back, away from the handle structure, the lever arms pivot about the ends of the handle structure. The biasing member rollers allow relative motion between the lever arms and biasing member free ends as the string is drawn back.

Accordingly, it is an object of the present invention to teach an archery bow that may be dismantled for ease of travel and storage.

It is another object of the present invention to teach an archery bow that has an adjustable pull weight, allowing a single bow to accommodate various levels of skill.

A further object of the present invention is to teach an archery bow that provides high mechanical efficiency without a network of cables.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
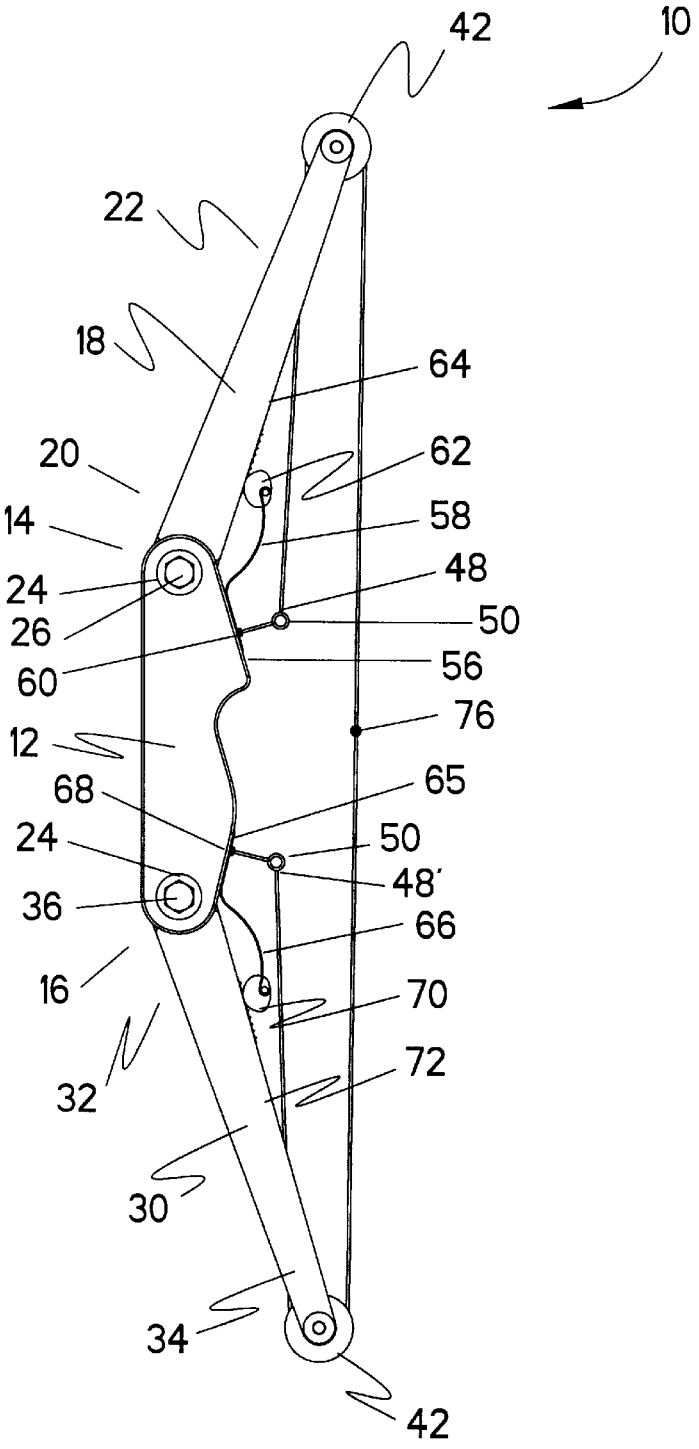
FIG. 1 is a side view of one embodiment of the archery bow of the present invention.
Figure 1A:
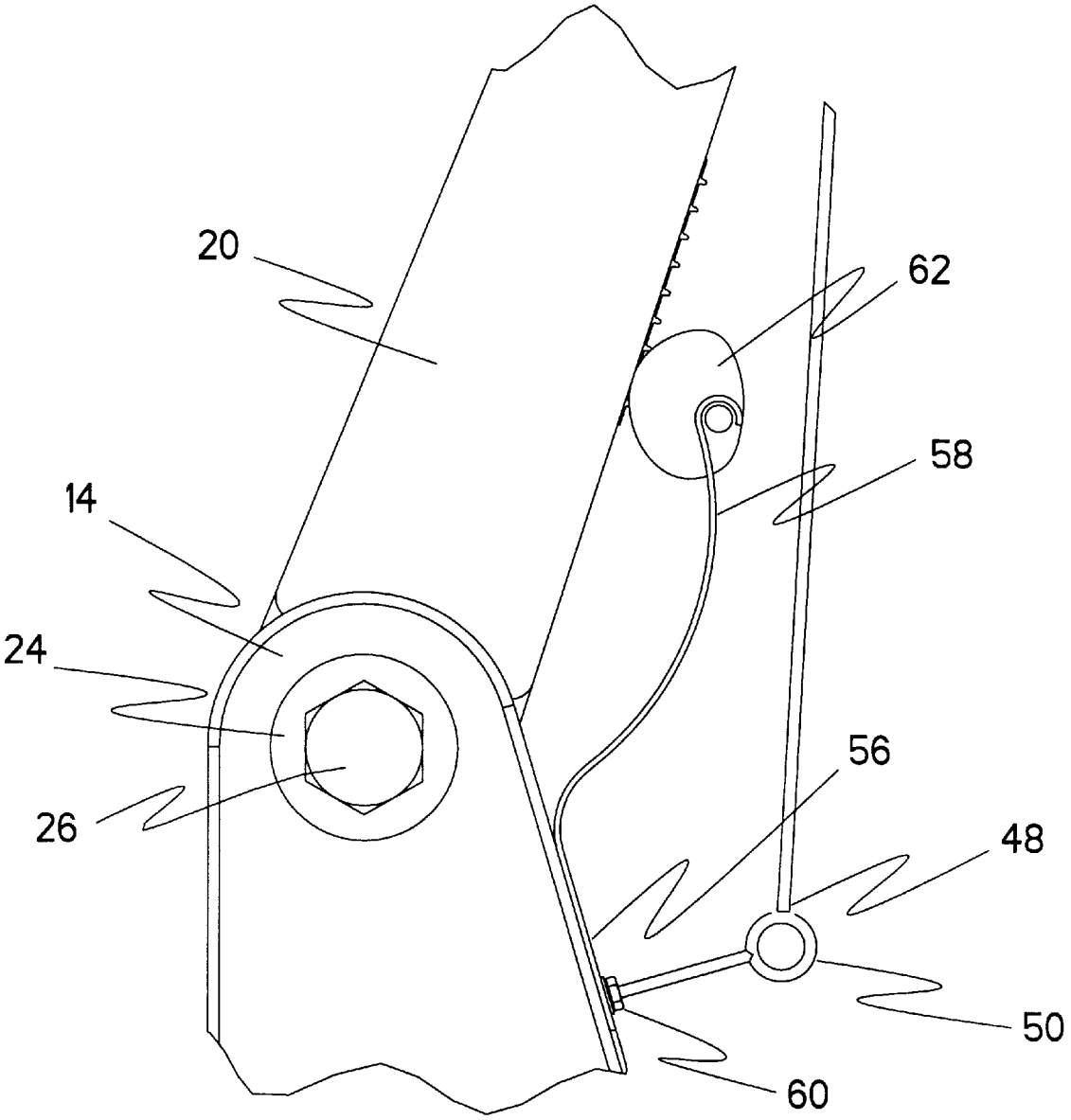
FIG. 1*a* is a partial side view of one embodiment of the archery bow of the present invention.

Now with reference to FIGS. 1 and 1*a*, the archery bow 10 of the present invention is illustrated. The bow 10 employs an elongated handle structure 12 having a first end 14 diametrically opposed from a second end 16. A first lever arm 18 has an attachment end 20 and a free end 22. The first lever arm attachment end 20 is shaped to fit within a valley in the Y-shaped first end 14 of the handle structure 12, and nylon bushings 24 are positioned to reduce friction therebetween. A first pivot bolt 26 cooperates with washers 28 to secure the first lever arm 18 to the handle structure first end 14, while allowing the first lever arm to pivot with respect to the handle structure 12.

In mirror image fashion, a second lever arm 30 is pivotally attached to the handle second end 16. The second lever arm 30 has an attachment end 32 and a free end 34. The second lever arm attachment end 32 is shaped to fit within a valley in the Y-shaped second end 16 of the handle structure 12, and nylon bushings 24 are positioned to reduce friction therebetween. A second pivot bolt 36 cooperates with washers 28 to secure the second lever arm 30 to the handle structure second end 16, while allowing the second lever arm to pivot with respect to the handle structure 12.

In keeping with the objects of this invention, the pivot bolts 26,36 are removable to allow selective separation of the lever arms 18,30 from the handle structure 12. However, the pivot bolts 26,36 may also be installed permanently if necessary.

Figure 2:
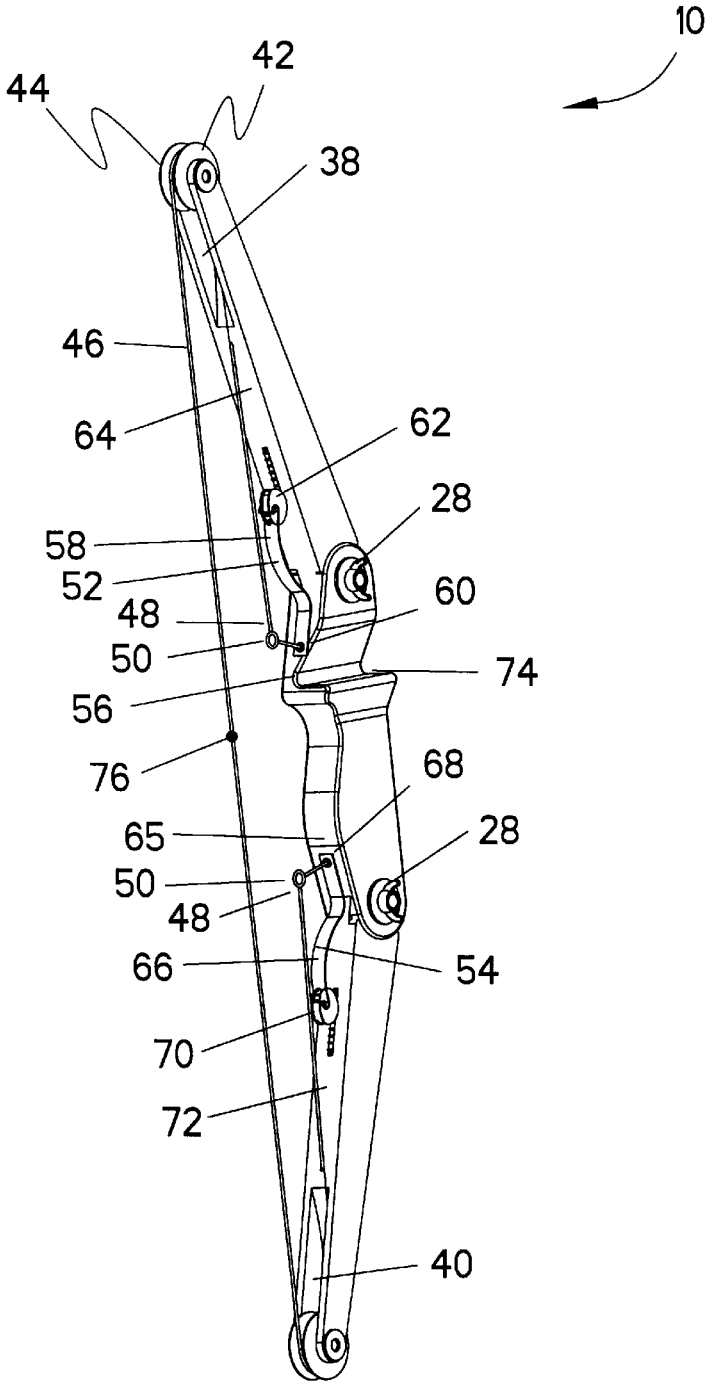
FIG. 2 is a rear view of the archery bow illustrated in FIG. 1.

Now referring also to FIG. 2, each lever arm free end 22,34 is characterized by a longitudinal cutout 38,40 and includes a circular bow string guide 42. The bow string guides 42 include a circumferential groove or channel 44 sized to accommodate an included bow string 46.

The bow string guides 42 cooperate with anchoring posts 50 on the handle structure 12 to ensure the bow string 46 is correctly positioned on the bow 10 at all times. More specifically, the bow string 46 is looped around the guides 42, with the bow string ends 48, 48' passing through the lever arm cutouts 38,40 and extending to the anchoring posts 50 on the handle structure 12. The ends of the bow string 46 are tethered to the anchoring posts 50, but may be removed as necessary for string replacement or storage of the bow 10.

The bow 10 also includes a pair of biasing bars 52,54 that each extend between the handle structure 12 and a corresponding lever arm 18,30. The first biasing bar 52 is a contoured, resiliently-deformable plank having a fixed end 56 and an opposite free end 58. The fixed end 56 is removably secured against the handle structure 12 by a threaded thumbscrew 60 that passes through the first biasing bar 52 and extends into the handle structure. The first biasing bar free end 58 includes a roller 62 that rests against the rear surface 64 of the first lever arm 18. Similarly, the second biasing bar 54 is a contoured, resiliently-deformable plank having a fixed end 65 and an opposite free end 66. The fixed end 65 is removably secured against the handle structure 12 by a threaded thumbscrew 68 that passes through the second biasing bar 54 and extends into handle structure. The second biasing bar free end 66 includes a roller 70 that rests against the rear surface 72 of the second lever arm 30.

In use, an arrow (not shown) is prepared for launching by placing the front and back of the arrow, respectively, on an arrow rest 74 and a nocking ring 76. The arrow rest 74 is disposed on the handle structure 12, and the nocking ring is located on the bow string 46. As the bow string 46 and arrow back end are drawn away from the handle structure 12, the lever arms 18,30 rotate on the pivot bolts 26,36, shortening the distance between the lever arm free ends 22,34. As the lever arms 18,30 rotate, each lever arm rear surface 64,72 engages a corresponding biasing bar roller 62,70. The rollers 62,70 allow the biasing bars 52,54 to support the lever arms 18,30, while permitting relative motion therebetween. In the preferred embodiment, the lever arms 18,30 are stiffer than the biasing bars 52,54 and drawing back the bow string causes the biasing bars to flex. When the biasing bars 52,54 flex, they store potential energy. Then, when the bow string 46 is released, the stored potential energy is transferred through the bow string to the loaded arrow, and the arrow is launched.

Although it has been described that the lever arms 18,30 are stiffer than the biasing bars 52,54, that is not the only suitable orientation. Depending upon archer preference and skill, the lever arms 18,30 and biasing bars 52,54 may flex equally; the lever arms may even be more flexible than the biasing bars. And, because the biasing bars 52,54 are secured with removable thumbscrews 60,68, the characteristics of a given bow 10 may advantageously be adjusted without extensive modification. Simply attaching different biasing bars will alter the bow performance, allowing the bow 10 to meet the demands of various archers and many different situations.

Figure 3:
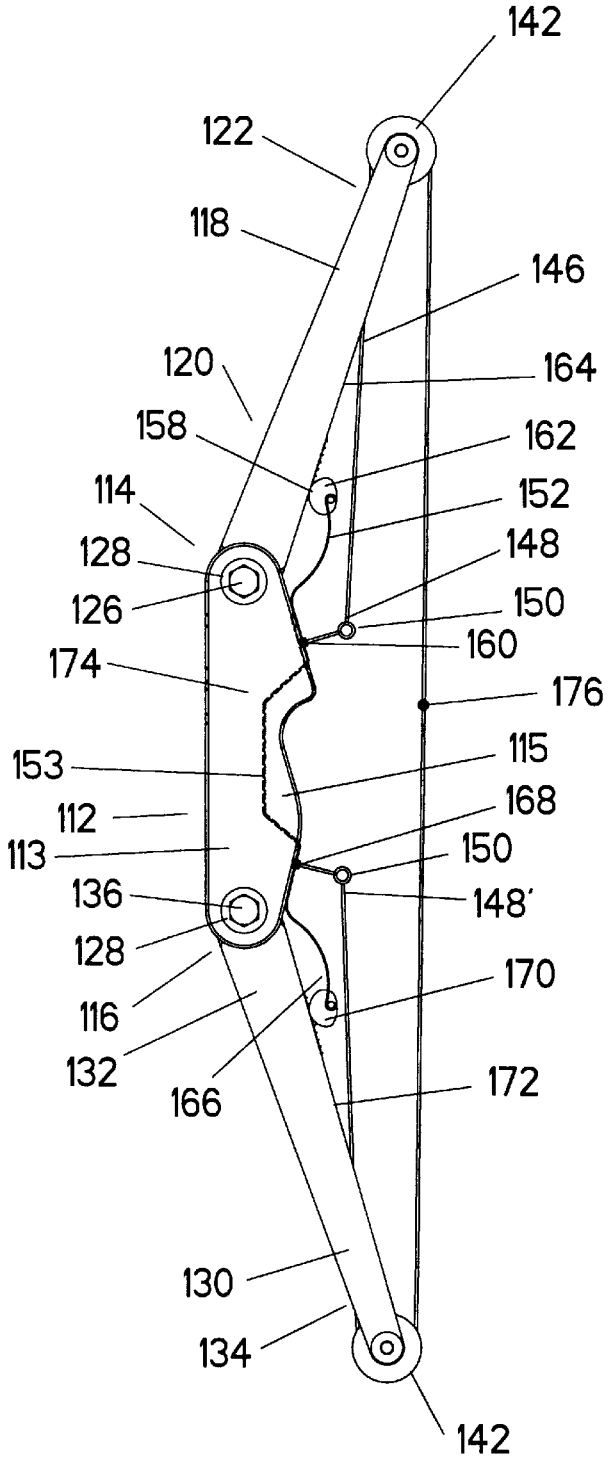
FIG. 3 is a side view of an additional embodiment of the archery bow of the present invention.

Now with reference to FIG. 3, a preferred embodiment of the archery bow 110 of the present invention is illustrated. The bow 110 employs an elongated handle structure 112 having a first end 114 diametrically opposed from a second end 116. A first lever arm 118 has an attachment end 120 and a free end 122. The first lever arm attachment end 120 is shaped to fit within a valley in the Y-shaped first end 114 of the handle structure 112, and nylon bushings 124 are positioned to reduce friction therebetween. A first pivot bolt 126 cooperates with washers 128 to secure the first lever arm 118 to the handle structure first end 114, while allowing the first lever arm to pivot with respect to the handle structure 112.

In mirror image fashion, a second lever arm 130 is pivotally attached to the handle second end 116. The second lever arm 130 has an attachment end 132 and a free end 134. The second lever arm attachment end 132 is shaped to fit within a valley in the Y-shaped second end 116 of the handle structure 112, and nylon bushings 124 are positioned to reduce friction therebetween. A second pivot bolt 136 cooperates with washers 128 to secure the second lever arm 130 to the handle structure second end 116, while allowing the second lever arm to pivot with respect to the handle structure 112.

In keeping with the objects of this invention, the pivot bolts 126,136 are removable to allow selective separation of the lever arms 118,130 from the handle structure 112. However, the pivot bolts 126,136 may also be installed permanently if necessary.

Figure 4:
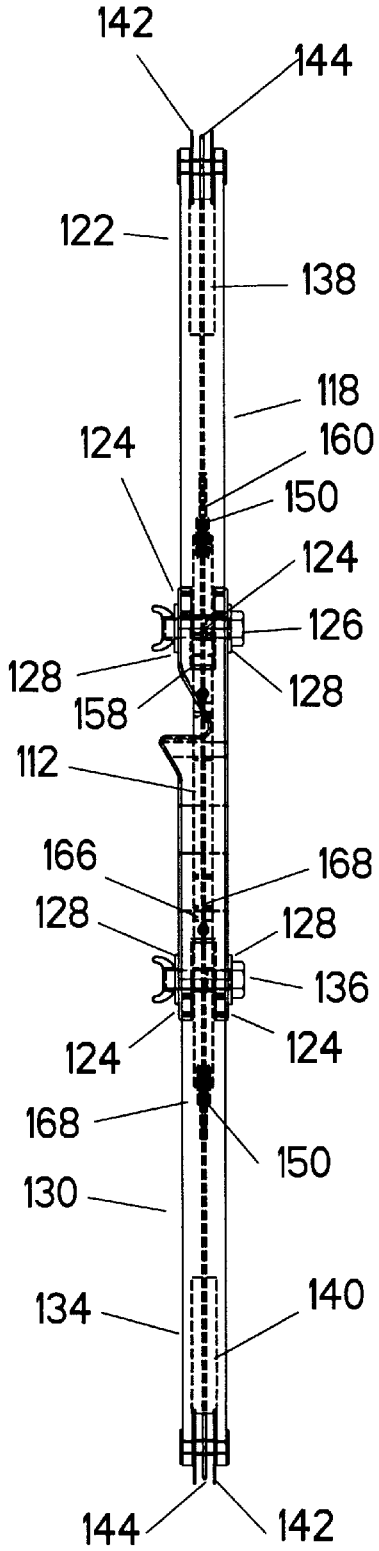
FIG. 4 is a rear view of the archery bow illustrated in FIG. 3.

Now referring also to FIG. 4, each lever arm free end 122,134 is characterized by a longitudinal cutout 138,140 and includes a circular bow string guide 142. The bow string guides 142 include a circumferential groove or channel 144 sized to accommodate an included bow string 146.

The bow string guides 142 cooperate with anchoring posts 150 on the handle structure 112 to ensure the bow string 146 is correctly positioned on the bow 110 at all times. More specifically, the bow string 146 is looped around the guides 142, with the bow string ends 148, 148' passing through the lever arm cutouts 138,140 and extending to the anchoring posts 150 on the handle structure 112. The ends of the bow string 146 are tethered to the anchoring posts 150, but may be removed as necessary for string replacement or storage of the bow 110.

In this embodiment, the bow handle 112 is comprised of two pieces: a main portion 113 and a retention portion 115. The main portion 113 and retention portion 115 are spaced apart by a biasing plate 152 disposed therebetween. The main portion 113, biasing plate 152, and retention portion 115 fit together, sandwich-style, and are secured together by thumbscrews 160,168 passing therethrough. The thumbscrews 160,168 are removable without tools and allow removal of the retention portion 115. When the retention portion 115 is detached, the biasing plate 152 may be exchanged for an alternate biasing plate 152' to alter the properties of the bow 110.

The biasing plate 152 extends longitudinally from between the handle main portion 113 and retention portion 115. As such, the biasing plate is characterized by a first free end 158 spaced apart from an opposite second free end 166 by a fixed middle portion 153. More specifically, the fixed middle portion 153 is sandwiched between the handle main portion 113 and retention portion 115, but the plate free ends 158,166 are not. The free ends 158,166 each include a roller 162,170 that rests against the rear surface of a corresponding lever arm 118,130. The first free end roller 162 engages the rear surface of the first lever arm 118, and the second free end roller 170 engages the rear surface of the second lever arm 130.

In use, an arrow (not shown) is prepared for launching by placing the front and back of the arrow, respectively, on an arrow rest 174 and a nocking ring 176. The arrow rest 174 is disposed on the handle main portion 113, and the nocking ring is located on the bow string 146. As the bow string 146 and arrow back end are drawn away from the handle structure 112, the lever arms 118,130 rotate on the pivot bolts 126,136, shortening the distance between the lever arm free ends 122,134. As the lever arms 118,130 rotate, each lever arm rear surface 164,172 engages a corresponding biasing plate roller 162,170. The rollers 162,170 allow the biasing bar free ends 158,166 to support the lever arms 118,130, while permitting relative motion therebetween. The lever arms 118,130 are stiffer than the biasing bar 152, and drawing back the bow string causes the free ends 158,166 of the biasing bar to flex. When the free ends 158,166 flex, they store potential energy. Then, when the bow string 146 is released, the stored potential energy is transferred through the bow string to the loaded arrow, and the arrow is launched.

Although it has been described that the lever arms 118, 130 are stiffer than the biasing bar free ends 158,166, that is not the only suitable orientation. Depending upon archer preference and skill, the lever arms 118,130 and biasing bar free ends 158,166 may flex equally; the lever arms may even be more flexible than the biasing bar free ends 158,166. And, because the biasing bar 152 is removably secured between the handle main portion 113 and the retention portion 115 with thumbscrews 160,168, the characteristics of a given bow 110 may advantageously be adjusted without extensive modification. Simply inserting a different biasing bar 152 will alter the bow performance, allowing the bow 110 to meet the demands of various archers and many different situations.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. An archery bow comprising:

a handle structure having a first end and a second end;

a first lever arm having a free end and an attachment end, said attachment end pivotally coupled to said handle structure first end;

a second lever arm having a free end and an attachment end, said attachment end pivotally coupled to said handle structure second end;

at least two anchor posts located on said handle structure;

a bow string having a first end selectively secured to one of said anchor posts and a second end selectively secured to a second said anchor post;

a bow string guide means for directing motion of said bow string relative to said lever arms and said handle structure; and biasing means for storing energy produced by motion of said lever arms with respect to said handle structure when said bow string is pulled in a rearward direction away from said handle structure.

2. The archery bow of claim 1, wherein:

said lever arms are removably attached to said handle structure.

3. The archery bow of claim 1, wherein:

said at least one anchor post extends from said handle structure.

4. The archery bow of claim 1, wherein:

said guide means includes at least one rotatable wheel disposed on said lever arm free ends, said wheel including a circumferential groove sized to accept said bow string.

5. The archery bow of claim 1, wherein:

said guide means includes at least one cylindrical post disposed on said lever arm free ends.

6. The archery bow of claim 1, wherein:

said biasing means includes a resiliently-deformable biasing plate removably attached to said handle, said plate characterized by a first free end spaced apart from a second free end by a fixed middle portion.

7. The archery bow of claim 6, wherein:

said biasing plate free ends flex a predetermined distance when loaded with a predetermined force.

8. The archery bow of claim 6, wherein:

each of said biasing plate free ends includes a roller, whereby friction between said biasing bars and said lever arms is negligible.

9. The archery bow of claim 8, wherein:

each of said rollers has an oblong cross-section, whereby the amount of force required to move said bow string is an inverse function of the distance between predetermined points on said bow string and said handle structure.

10. The archery bow of claim 6, wherein:

said biasing plate free ends deflect a first predetermined distance when loaded by a first predetermined force and said lever arms deflect a second predetermined distance when loaded by said first predetermined force, said first predetermined distance being greater than said second predetermined distance.

11. The archery bow of claim 6, wherein:

said biasing plate free ends deflect a first predetermined distance when loaded by a first predetermined force and said lever arms deflect a second predetermined distance when loaded by said first predetermined force, said first predetermined distance equaling said second predetermined distance.

12. The archery bow of claim 6, wherein:

said biasing bars deflect a first predetermined distance when loaded by a first predetermined force and said lever arms deflect a second predetermined distance when loaded by said first predetermined force, said first predetermined distance being smaller than said second predetermined distance.

13. The archery bow of claim 1, wherein said biasing means includes:

a first biasing bar having a fixed end removably secured to said handle structure first end, and a free end; and a second biasing bar having a fixed end removably secured to said handle structure second end, and a free end.

14. The archery bow of claim 13, wherein:

said biasing plate free ends flex a predetermined distance when loaded with a predetermined force.

15. The archery bow of claim 13, wherein:

each of said biasing bar free ends includes a roller, whereby friction between said biasing bars and said lever arms is negligible.

16. The archery bow of claim 15, wherein:

each of said rollers has an oblong cross-section, whereby the amount of force required to move said bow string is an inverse function of the distance between predetermined points on said bow string and said handle structure.

17. The archery bow of claim 13, wherein:

said biasing bars deflect a first predetermined distance when loaded by a first predetermined force and said lever arms deflect a second predetermined distance when loaded by said first predetermined force, said first predetermined distance being greater than said second predetermined distance.

18. The archery bow of claim 13, wherein:

said biasing bars deflect a first predetermined distance when loaded by a first predetermined force and said lever arms deflect a second predetermined distance when loaded by said first predetermined force, said first predetermined distance equaling said second predetermined distance.

19. The archery bow of claim 13, wherein:

said biasing bars deflect a first predetermined distance when loaded by a first predetermined force and said lever arms deflect a second predetermined distance when loaded by said first predetermined force, said first predetermined distance being smaller than said second predetermined distance.

20. An archery bow comprising:

a handle structure having a first end and a second end;

a first lever arm having a free end and an attachment end, said attachment end pivotally coupled to said handle structure first end, said first lever arm being removably attached to said handle structure;

a second lever arm having a free end and an attachment end, said attachment end pivotally coupled to said handle structure second end, said second lever arm being removably attached to said handle structure;

at least two anchor posts extending from said handle structure;

a bow string having a first end selectively secured to one of said anchor posts and a second end selectively secured to a second said anchor post;

at least one rotatable wheel disposed on said lever arm free ends for directing motion of said bow string relative to said lever arms and said handle structure, said wheel including a circumferential groove sized to accept said bow string; and a resiliently-deformable biasing plate removably attached to said handle, said biasing plate characterized by a first free end spaced apart from a second free end by a fixed middle portion, said biasing plate free ends flex a predetermined distance when loaded with a predetermined force, each of said biasing plate free ends including a roller.

21. An archery bow comprising:

a handle structure having a first end and a second end;

a first lever arm having a free end and an attachment end, said attachment end pivotally coupled to said handle structure first end, said lever arm being removably attached to said handle structure;

a second lever arm having a free end and an attachment end, said attachment end pivotally coupled to said handle structure second end, said lever arm being removably attached to said handle structure;

at least two anchor posts extending from said handle structure;

a bow string having a first end selectively secured to one of said anchor posts and a second end selectively secured to a second said anchor post;

at least one rotatable wheel disposed on said lever arm free ends, said wheel including a circumferential groove sized to accept said bow string to direct motion of said bow string relative to said lever arms and said handle structure;

a first biasing bar having a fixed end removably secured to said handle structure first end, a free end, and a roller disposed on said free end; and a second biasing bar having a fixed end removably secured to said handle structure second end, a free end, and a roller disposed on said free end.

* * * * *